United States Patent [19]

Pondorfer

[11] Patent Number: 4,623,036

[45] Date of Patent: Nov. 18, 1986

[54] ELECTRO SEAT

[76] Inventor: Walter Pondorfer, A - 9991 Dölsach -Römerweg 1, Tirol, Austria

[21] Appl. No.: 754,855

[22] Filed: Jul. 12, 1985

[51] Int. Cl.[4] ..... E04G 3/10

[52] U.S. Cl. ..... 182/142; 182/150

[58] Field of Search ..... 182/142, 145, 150, 73–75; 187/11

[56] References Cited

U.S. PATENT DOCUMENTS

| | | | |
|---|---|---|---|
| 1,630,948 | 5/1927 | Karikas | 182/7 |
| 3,360,315 | 12/1971 | Meyer | 182/142 |

FOREIGN PATENT DOCUMENTS

| | | | |
|---|---|---|---|
| 239067 | 3/1965 | Austria | 182/75 |
| 286501 | 8/1915 | Fed. Rep. of Germany | 182/150 |
| 1341538 | 9/1963 | France | 182/142 |
| 625310 | 9/1961 | Italy | 182/142 |
| 1074649 | 7/1967 | United Kingdom | 182/142 |

*Primary Examiner*—Reinaldo P. Machado
*Attorney, Agent, or Firm*—Bachman & LaPointe

[57] ABSTRACT

A self-propelled carriage for climbing a rope suspended from a high structure to which access is desired, the carriage being equipped with a seat, a motor and a motor driven shaft for engaging the rope. The rope may be wrapped around the shaft to clutch the rope in the manner of a windlass. The shaft may have a frictional surface and/or a spiral track to receive the rope.

5 Claims, 6 Drawing Figures

FIG-4
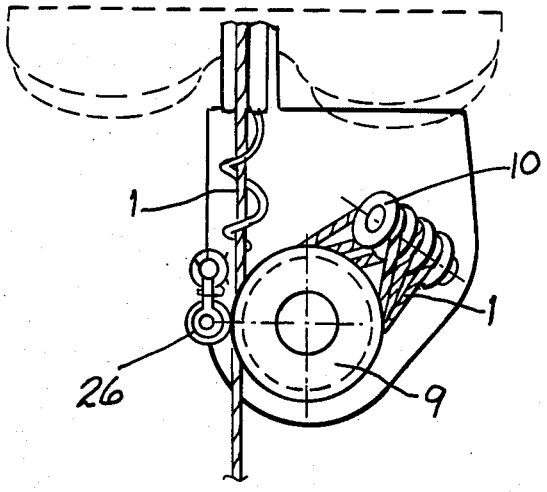
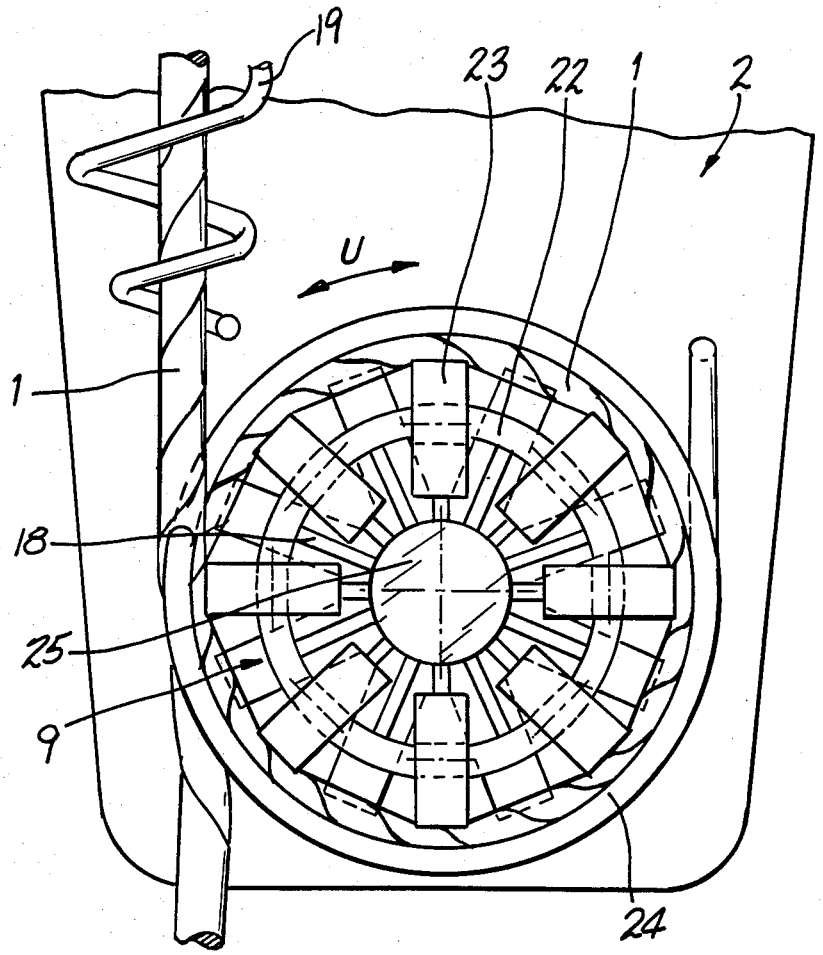
FIG-5

ELECTRO SEAT

BACKGROUND OF THE INVENTION

The invention applies to a hanging-stage resembling a hoisting-cage, especially designed for workers on tower roofs, pylons and the like. It is equipped with a supporting device preferably designed as a seat for one person which can be raised and lowered along a single rope. The seat is by preference suspended from the tower and is consequently free to swing.

Working on building walls without having recourse to a scaffold is achieved by a large number of cradles which can be shifted along the walls both horizontally and vertically. Such cradles are usually supported by a rope running up and down a guide rail temporarily set up on the wall of the building (say) or fixed to it. It is also well-known that cradles of this kind must be equipped with winches to raise and lower them. However, the winches needed in these cases are of considerable weight and call for a high lifting capacity of the mounting support. Besides, they take up much space and thus make the cradle smaller in size.

Another method is to suspend the cradle from fixed holders or hooks. To cite an example, the German Patent Specification No. 106 740 describes a scaffold support propped against the wall. Rings attached to this support hold the scaffolding by means of pulley blocks.

At least two ropes and two hooks are required to suspend or shift these cradles. They are difficult to assemble and of no use for carrying out repair works on the roofs of towers and steeples.

It is common knowledge that pulley blocks or winches can be fixed to a chain, the latter usually being kept taut between two clamps.

Such appliances are hardly suitable for works on the generally narrow and steep tower roofs, or on pylons and chimneys. Proposals were made as to attach cradles to the pole of the spire helm but this proved little satisfactory regarding the workman's mobility. Moreover, tying the cradle to the spire and detaching it after the operation often raised insurmountable problems.

The AT-PS No. 330 436 specifies a seat suspended from a single rope and tied to a tower, and which is free to swing. The workman can pull himself up along the tower and swing freely around it with both hands free to work. This contrivance is particularly well-suited for the roofing of towers and all operations which keep the workman suspended at the same level for a prolonged period of time.

The invention aims at creating a hanging stage resembling a hoisting-cage of the above-mentioned kind. Its improvement when compared with the cradle described above is due to the fact that it can be raised and lowered quickly and without any difficulty.

SUMMARY OF THE INVENTION

The inventor's achievement is a motor fitted to the supporting device which turns a driving shaft around which the rope is looped. Thus the motor is used to raise and lower the supporting device along the rope.

The inventor's hanging stage is particularly well-suited for the painting of pylons, chimneys and other tall constructions. It is important to note that motor operation makes it possible for the workman to take along heavy buckets with paint and to carry them upwards covering great distances.

It is an essential feature of the present invention that the supporting device designed as a seat can be raised and lowered along an unstretched rope. When using the invention it is therefore sufficient to suspend a rope from the tower, etc., drop it, and attach the supporting device to it as described below. Subsequently the supporting device can be carried up along this rope.

The driving shaft over which the rope passes is preferably equipped with ring-shaped grooves. An embodiment of the invention provides for a freewheel by-pass roller, preferably equally grooved, next to the driving shaft, to improve the guide of the rope. The axes of the driving shaft and the by-pass roller respectively are by preferance at an angle $\alpha$ which passes the rope out of the respective ring-shaped groove to the groove of the opposite by-pass roller or driving shaft.

According to another advantageous embodiment the driving shaft is formed by a number of rings in tandem arrangement with radially arranged bearings, preferably ball bearings, rotating around these rings. The driving shaft is surrounded by a fixed guide helix. The clearance between the bearings and the helix is smaller than the diameter of the rope.

By means of the inventor's embodiment the rope can very easily creep towards the axes of the driving shaft but is fixed in the circuit direction of the shaft, the bearings which are arranged side-by-side in the circuit direction and diagonally to it forming virtually a tooth-shaped scanning.

By preference the bearings or ball bearings respectively of adjoining rings gear into each other like cogwheels. Thus a particularly dense bearing compound can be obtained.

According to an embodiment of the invention the diameter of the driving shaft is larger than the diameter of the by-pass roller.

To improve the adhesion of the rope on the above specified kind of driving shaft combined with a tension roller, it is advantageous to provide the driving shaft with a friction-heightening coating, e.g. a rubber coating which runs around the driving shaft within its ring-shaped grooves.

BRIEF DESCRIPTION OF THE DRAWINGS

In the following we shall describe in detail two embodiments of the invention by means of the diagrams on the enclosed drawings. These embodiments are by no means to be regarded as restrictive prescriptions.

FIGS. 3 and 4 show diagrams of the driving shaft and the by-pass roller respectively.

FIG. 5 shows another embodiment of a driving shaft in axial direction.

DETAILED DESCRIPTION

Figure 1:
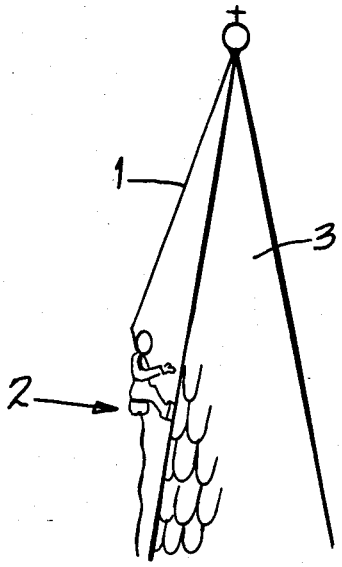
FIG. 1 is a schematic representation of the inventor's hanging stage in operating position.

The essential parts of the inventor's hanging stage are the rope 1 and the supporting device designed as a seat 2. FIG. 1 shows that the rope 1 is conventionally attached to a tower-like construction 3. The supporting device 2 has a seat 4 and a tie beam 5. The upper end of the tie beam 5 is equipped with a guide roller 6 for the rope 1. Under the seat 4 there is the motor 7 which can be controlled by means of a switchgear 8.

Figure 2:
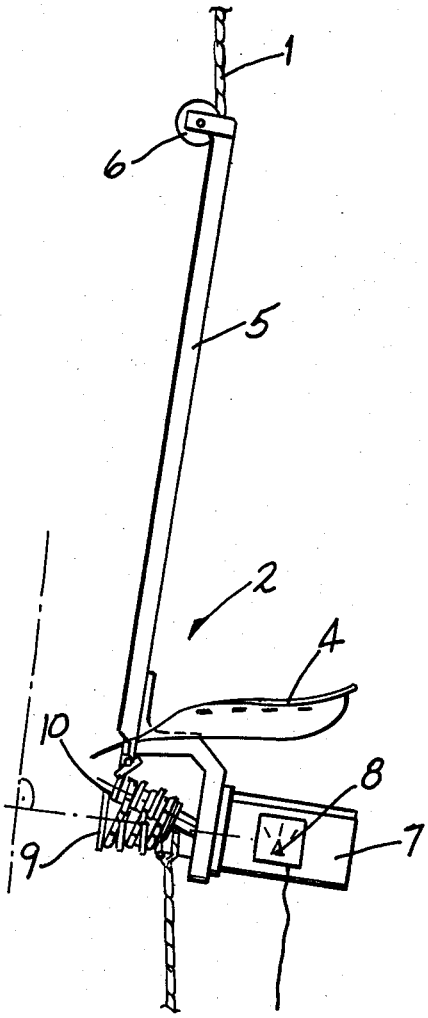
FIG. 2 shows a schematic diagram of the inventor's hoisting cage.
Figure 3:
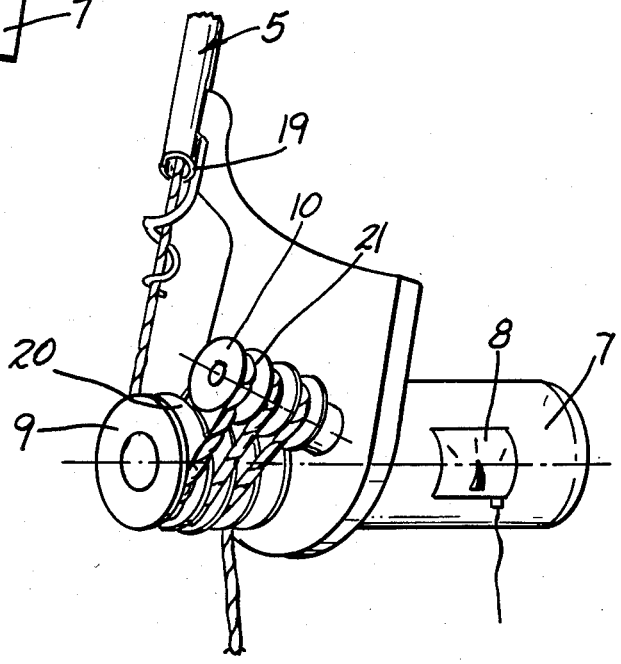
Figure 6:
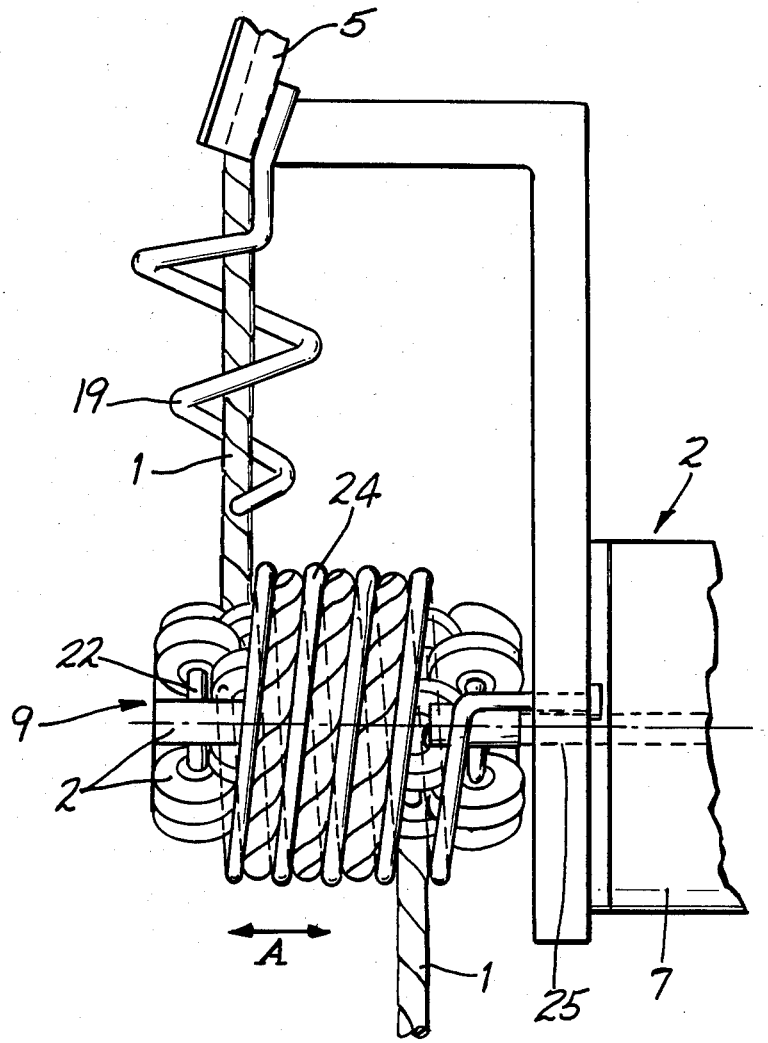
FIG. 6 shows the same embodiment in radial direction.

At the tie beam 5 overhead the rope 1 is passed between the guide roller 6 and the tie beam 5 itself, which prevents the supporting device 2 from tipping over. Under the seat 4 the rope 1 is looped around the driving shaft 9; according to the embodiment of the FIGS. 2 to 4 it is also looped around a by-pass roller 10. The free lower end of the rope 1 is dropped freely from the driving shaft 9. FIG. 3 shows that at least the lower part of the tie beam 5 is designed in the shape of a tube with the rope 1 passing through this tube. Additionally there is a helix 19 underneath to improve the guide of the rope 1.

The driving shaft 9 is at a right angle with the tie beam 5 or the guide tube 5 respectively to assure a steady hauling-in of the rope.

FIG. 3 in particular shows that both the driving shaft 9 and the by-pass roller 10 are provided with ring-shaped grooves 20, 21, in the deepenings of which the rope 1 is threaded.

Thus the rope 1 is positively prevented from slipping off the driving shaft 9.

The friction of the rope 1 on the driving shaft 9 can be improved by providing the latter with a coating heightening adhesion or friction—preferably a rubber coating. In the embodiment shown before this coating will be attached to the bottom of the ring-shaped grooves 20.

By choosing clockwise or anti-clockwise rotation of the driving shaft 9 through the steering mechanism the supporting device 2 can be raised or lowered along the rope 1.

Next to the driving shaft 9 there is a pressure roller 26 at the last groove 20 which presses the rope 1 against the driving shaft 9. The rope having passed through the pressure roller 26 and the driving shaft 9, it is paid out and dropped freely.

The supporting device according to the embodiment of diagrams 5 and 6 differs from the above-specified embodiment with regards to the design of the driving shaft 9 and in the fact there there is no by-pass roller 10. All other parts being identical, they will pass unmentioned in the following specification.

FIG. 5 in particular shows that according to this embodiment the driving shaft 9 is formed by several rings 22 in tandem arrangement and carries ball bearings 23 which thus form the case of the driving shaft 9. Struts 18 connect the rings 22 with the driving shaft 25 of the motor 7.

On the other hand, the rope 1 is helically looped around the driving shaft 9, a guide helix 24 fixed around the driving shaft 9 directing the spirals of the rope 1.

By means of the ball bearings 23 the rope can easily be shifted on the driving shaft in an axial direction, i.e. in the direction indicated by arrow A. The tooth-shaped design of the ball bearings 23 fixes the rope in the circuit direction (arrow U, FIG. 5). The rope rises as the driving shaft 9 is turned. When the driving shaft 9 is fixed, the rope 1 cannot possibly slide through.

The supporting device can be raised or lowered along the rope 1 by turning the driving shaft 9 to the right or to the left, as is the case with the embodiment specified above.

It stands to reason that within the scope of the invention additional safety devices can be fitted which clamp the supporting device 2 to the rope 1 in the contingent event of the motive power failing or the rope 1 being accidentally detached. The supporting device must be equipped with safety straps for the workman operating it.

The motor illustrated, by way of example, is an electric motor which can be battery operated or can be supplied by electric wiring from the elevated structure or from the ground, as may be convenient.

The invention permits a method in which an operator can gain access to a high structure, for example, for painting, repair work or otherwise. The method may involve several operators each working on separate carriages spaced-apart in the horizontal direction so that the operations can be carried out in record time. For one example, in the case of painting a transmission or television tower, a steeple, a mast, or chimney, for example, a number of ropes can be suspended from different sides of the tower with a carriage supported by each rope. In this way, several operators can paint areas spaced-apart in the horizontal direction progressively and simultaneously so that the tower is continuously painted vertically from top to bottom.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Hanging stage resembling a hoisting cage, especially for workers on tower roofs, pylons and the like, equipped with a supporting device preferably designed as a seat for one workman; the device ascending and descending on a single rope and by preferance suspended from a tower and hence free to swing, comprising a motor attached to the supporting device, turning a drive shaft around which the rope is looped, thus raising and lowering the supporting device by means of the motor along the rope, and wherein a freewheel by-pass roller equipped with ring-shaped grooves for receiving the rope is incorporated next to the driving shaft.

2. Hanging stage resembling a hoisting cage according to claim 1 wherein the axes of the driving shaft and of the by-pass roller are at an angle $\alpha$.

3. Hanging stage resembling a hoisting cage according to claim 1 wherein the driving shaft is formed by rings in tandem arrangement with radially arranged bearings rotating around the rings, the driving shaft is surrounded by a fixed guide helix for the rope, the clearance between the bearings and the guide helix being smaller than the diameter of the rope 1.

4. Hanging stage resembling a hoisting cage according to claim 3 wherein the bearings of adjoining rings gear into each other like cog-wheels.

5. Hanging stage resembling a hoisting cage according to claim 1 wherein the diameter of the driving shaft is larger that the diameter of the by-pass roller.

* * * * *